US006857360B2

(12) United States Patent
Heckmann

(10) Patent No.: US 6,857,360 B2
(45) Date of Patent: Feb. 22, 2005

(54) PRINTER WITH TYPE-BEARING PRINTING BANDS

(75) Inventor: Rainer Heckmann, Brombach (DE)

(73) Assignee: Checkpoint Systems International GmbH, Hirschhorn/Neckar (DE)

( * ) Notice: Subject to any disclaimer, the term of this patent is extended or adjusted under 35 U.S.C. 154(b) by 0 days.

(21) Appl. No.: 10/132,505

(22) Filed: Apr. 24, 2002

(65) Prior Publication Data

US 2002/0170447 A1 Nov. 21, 2002

Related U.S. Application Data

(63) Continuation of application No. PCT/EP01/09659, filed on Aug. 21, 2001.

(30) Foreign Application Priority Data

Aug. 24, 2000 (DE) ..... 100 41 522

(51) Int. Cl.[7] ..... B41J 27/00
(52) U.S. Cl. ..... 101/105; 101/93.11; 101/111
(58) Field of Search ..... 101/105, 111, 101/93.11, 93.12; 116/315

(56) References Cited

U.S. PATENT DOCUMENTS

| | | | | |
|---|---|---|---|---|
| 3,521,555 A | | 7/1970 | Price et al. | |
| 4,075,944 A | | 2/1978 | Conley | |
| 4,096,800 A | * | 6/1978 | Kistner et al. | 101/110 |
| 4,163,422 A | * | 8/1979 | Hamisch, Jr. | 101/105 |
| 4,212,261 A | * | 7/1980 | Gaetano | 116/224 |
| 4,271,759 A | * | 6/1981 | Volk | 101/110 |
| 4,325,302 A | * | 4/1982 | Beers | 101/111 |
| 4,628,812 A | | 12/1986 | Fisk | |
| 5,731,543 A | * | 3/1998 | Jorgensen | 174/65 R |
| 5,992,312 A | * | 11/1999 | Faber | 101/105 |
| 6,009,805 A | * | 1/2000 | Miketa et al. | 101/109 |

FOREIGN PATENT DOCUMENTS

| | | |
|---|---|---|
| DE | 28 04 295 A1 | 8/1978 |
| DE | 29 41 327 A1 | 4/1980 |
| DE | 34 27 858 A1 | 2/1986 |
| DE | 42 14 216 A1 | 11/1993 |
| EP | 0 047 874 A1 | 3/1982 |
| EP | 0 867 303 A1 | 9/1998 |
| EP | 0 992 356 A1 | 4/2000 |

* cited by examiner

*Primary Examiner*—Andrew H. Hirshfeld
*Assistant Examiner*—Dave A. Ghatt
(74) *Attorney, Agent, or Firm*—Caesar, Rivise, Bernstein, Cohen & Pokotilow, Ltd.

(57) ABSTRACT

A printer (15) for hand-labeling devices (1) has printing bands (57) bearing print types (17). Each band is positively guided around a selector wheel (53) and around a counter-pressure element (55) spaced apart from the wheel. Selected types (17) are set into printing position on the counter-pressure element (55) by rotation of the selector wheel (53). The selector wheel (53) has engagement recesses (60) into which a stop member elastically engages when a printing position is reached, thereby fixing the selector wheel (53), and hence the printing band (57), in the printing position. The stop member is provided as a comb-shaped stop spring (66) having individual teeth or elastic tongues (61*a* thru 61*x*), with one elastic tongue being associated with each selector wheel (53).

3 Claims, 6 Drawing Sheets

PRINTER WITH TYPE-BEARING PRINTING BANDS

CROSS-REFERENCE TO RELATED APPLICATIONS

This application is a continuation of International Application No. PCT//EP01/09659, filed Aug. 21, 2001, the disclosure of which is incorporated herein by reference.

BACKGROUND OF THE INVENTION

This invention is directed to a printer with type-bearing printing bands, each of which is positively guided around a selector wheel and around a counter-pressure element spaced apart from the wheel. Selected print types are set into printing position on the counter-pressure element by rotation of the selector wheel. The selector wheel has engagement recesses into which a stop member elastically engages when a printing position is reached, thereby fixing the selector wheel, and hence the printing band, in the printing position.

The exact positioning of the print types represents a major problem in the functioning capability of hand-labeling devices, such as those described in EP 187 986 and DE 198 48 977. Various proposals for securely positioning the types are known from the prior art.

For example, DE 26 21 294 describes a printer head with a transport wheel and a support means, about which a band of types is stretched. The printing block, designed as a tape, has projections on its back that engage with a groove formed in the support. The types are positioned by means of this engagement.

DE 30 34 923 shows a band printer in which the bands of type are each stretched around a selector wheel and a star wheel. The star wheels, each designed as a square, are held in position by an elastic tongue arranged on a base part. One single elastic tongue is assigned to each star wheel. The elastic tongues, which are arranged on the star wheel at a specific angle to the print surface, exert spring action in a lateral and upward direction when the type tape is moved. Thus, each star wheel according to DE 30 34 923 is individually spring-biased for the positioning of a specific type. This cannot ensure that the types involved in the printing process and arranged at a distance from the switching system are held precisely in one line. This detracts from the appearance of the print.

A hand printing device with a plurality of selector wheels and a type locator is known from EP 0 628 420. The bands of type are stretched about the selector wheels and the type locator. A click component is pressed into the tooth gaps of the selector wheel via an elastic pre-stressing component to prevent an unnecessary turning of the selector wheels. According to EP 0 628 420, all selector wheels are acted upon simultaneously in that the click component is pressed into a tooth gap of each respective selector wheel. As a result, if one single selector wheel is moved, the click component frequently escapes from all of the tooth gaps. Therefore, it is not possible to guarantee that the remaining selector wheels stay in a fixed position.

BRIEF SUMMARY OF THE INVENTION

An object of the present invention is therefore to provide a printer that permits a secure and exact positioning of the selector wheels and thus of the print types to be set, using simple and economical means.

This object is achieved by the present invention, which includes a printer with type-bearing printing bands, each of which is positively guided around a selector wheel and around a counter-pressure element spaced apart from the wheel. The individual selected print types can be set into printing position on the counter-pressure element by rotation of the selector wheel. The selector wheel has engagement recesses into which a stop member engages when a printing position is reached, thereby fixing the selector wheel, and hence the printing band, in the printing position. This stop member according to the invention is designed as an elastic tongue. One elastic tongue is assigned to each selector wheel, and all elastic tongues are part of one and the same spring comb. Through the individual action upon each single selector wheel, and in conjunction with the counter-pressure element, an exact and secure positioning of the selected types in their respective printing position is guaranteed. The displacement of one elastic tongue leaves the adjacent elastic tongues completely unaffected.

According to a preferred embodiment of the present invention, the elastic tongues engaging in the engagement recesses of the selector wheels are formed on a common base part like the teeth of a comb, with the same spacing as the selector wheels. Together with this base part they form a comb-shaped stop spring. This guarantees a simple and economical production of the stop member, economical production of the printer, and in particular an exact and lasting accurate alignment of the types involved in the printing process.

In the printer according to the invention, the elastic tongue used for each selector wheel exerts a force on the selector wheel, which starts from the beginning of the rotation of the associated selector wheel and increases up to a maximum value. The maximum value is reached when the selector wheel has reached a position in the middle between two engagement positions. Afterwards, the force decreases until the next engagement position is reached. Therefore, for a secure and exactly reproducible positioning of the types it is important that the elastic tongues be made of a material that, in addition to resistance to deformation, also possesses the elasticity required to surmount the position between two engagement positions. Metals and metal alloys especially have the required properties. In a preferred embodiment of the present invention, the elastic tongues and the base part are made of such materials. Spring sheet steel has particularly favorable properties combined with low production costs.

According to a particularly preferred embodiment of the present invention, the section of the elastic tongues that engages in a respective engagement recess of the selector wheels is arc-shaped. The arcuate design ensures problem-free gliding of the elastic tongue along the surface of the selector wheel, when a print type receives a new positioning through rotation of the selector wheel.

A most secure and exact type positioning results if the section of the elastic tongues that engages in an engagement recess of the selector wheels is designed in a shape adapted to that of the engagement recesses. The positive fit of the elastic tongue and the engagement recess rules out slippage of the types from the printing position. Therefore, this design constitutes a particularly preferred embodiment of the present invention.

According to a preferred embodiment, a retaining block into which the base part positively engages can be used to fix the elastic tongues in a printer. The retaining block is mounted between the selector wheels and the counter-pressure elements.

The above-described embodiments of the printer according to the invention are utilized particularly in labeling and marking devices. The printer according to the invention is especially advantageous as part of a hand-labeling device.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 6:
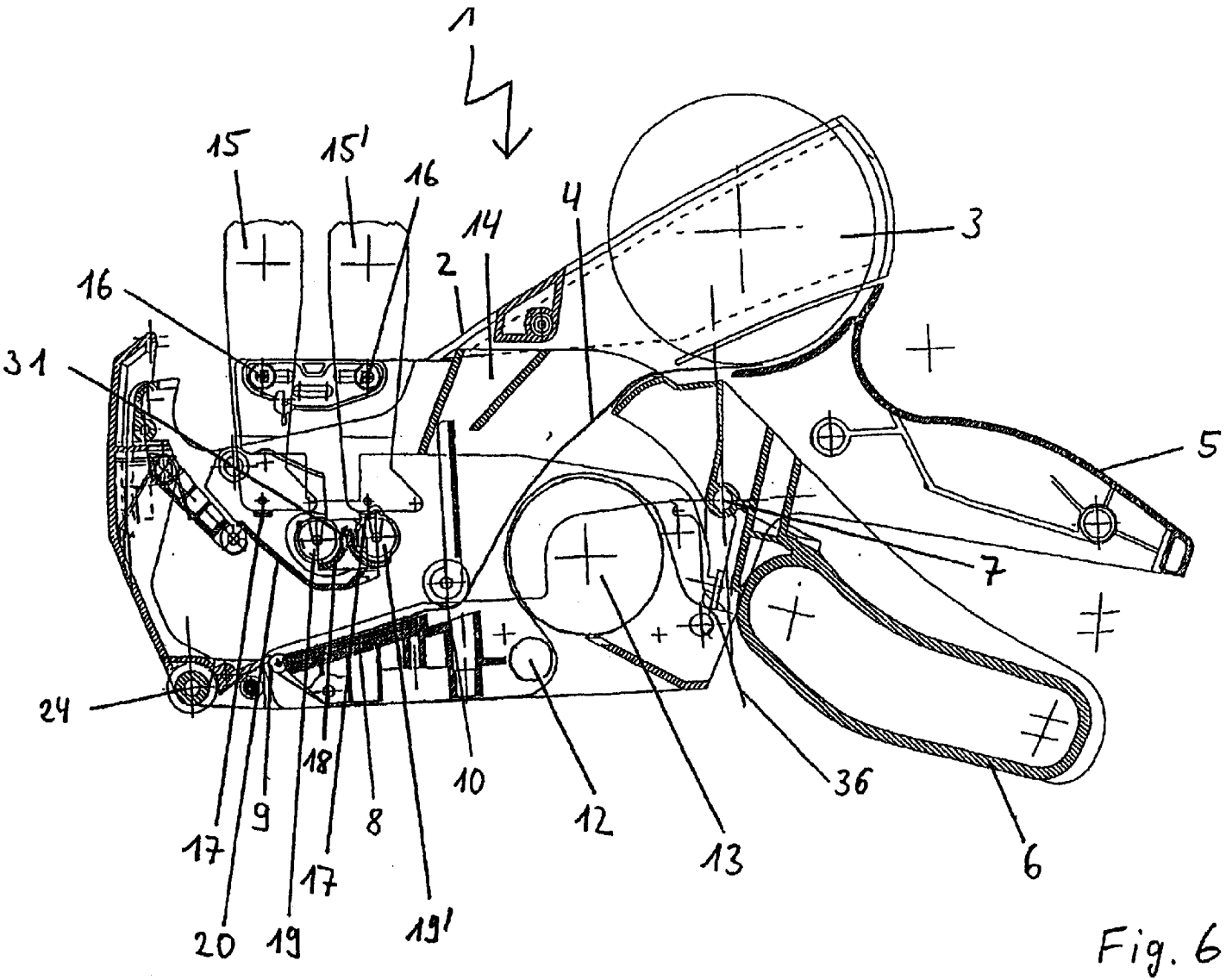
FIG. 6 is a cross-sectional view of a hand-labeling device with a printer according to the invention.

FIG. 6 shows a hand-labeling device designated as a whole by 1, with two printers 15, 15' according to the invention. Labels can be printed and fed out with the hand-labeling device 1 for application to an object to be labeled. For this purpose, the hand-labeling device 1 has a label supply roll 3 disposed in a casing 2. The label tape 4 wound onto the supply roll 3 is fed into the interior of the casing, past a deflection roller 10 and onto a printing bed 8, on which one label at a time arrives at a printing position beneath the printer 15 according to the invention. The label tape 4 is guided downstream of the printing bed 8 around a dispensing edge 9, at which it is sharply deflected downwards and to the rear, so that a label in position to be dispensed separates from a carrier tape 36 at the dispensing edge 9, due to the different stiffness of the materials of the carrier tape 36 and the label. The label can then be pressed onto an object to be labeled, by means of a pressure roller 24 mounted on the forward underside of the casing 2. The carrier tape is further transported in the lower rear region of the casing 2 by means of a deflection roller 12 and a transport wheel 13 in steps equal to the extent of one label.

The label tape 4 is manually driven by an operator using a hand lever 6 and a handle 5 located to the rear of the casing 2. FIG. 6 shows the at rest position of the hand lever 6, into which it is urged by the force of a pull-back spring (not shown). The printers 15, 15' according to the invention, as well as the transport wheel 13 are driven by pivoting the hand lever 6 about a pivot bearing 7, i.e., counterclockwise toward the handle 5.

The printers 15, 15' are fastened by screws 16 to a printer rocker 14. When the handle 6 is actuated, the printers 15, 15' are moved towards the printing bed 8 by the swivel motion of the printer rocker 14 about the pivot bearing 7, where they print a label lying on the bed. Ink rollers 19, 19' charged with ink are provided to ink the types 17. The ink rollers are mounted on a carriage 18 so as to rotate. The carriage 18 is connected to an inking rocker 20 through a bearing 31 capable of rotation in the plane of the drawing.

Figure 1:
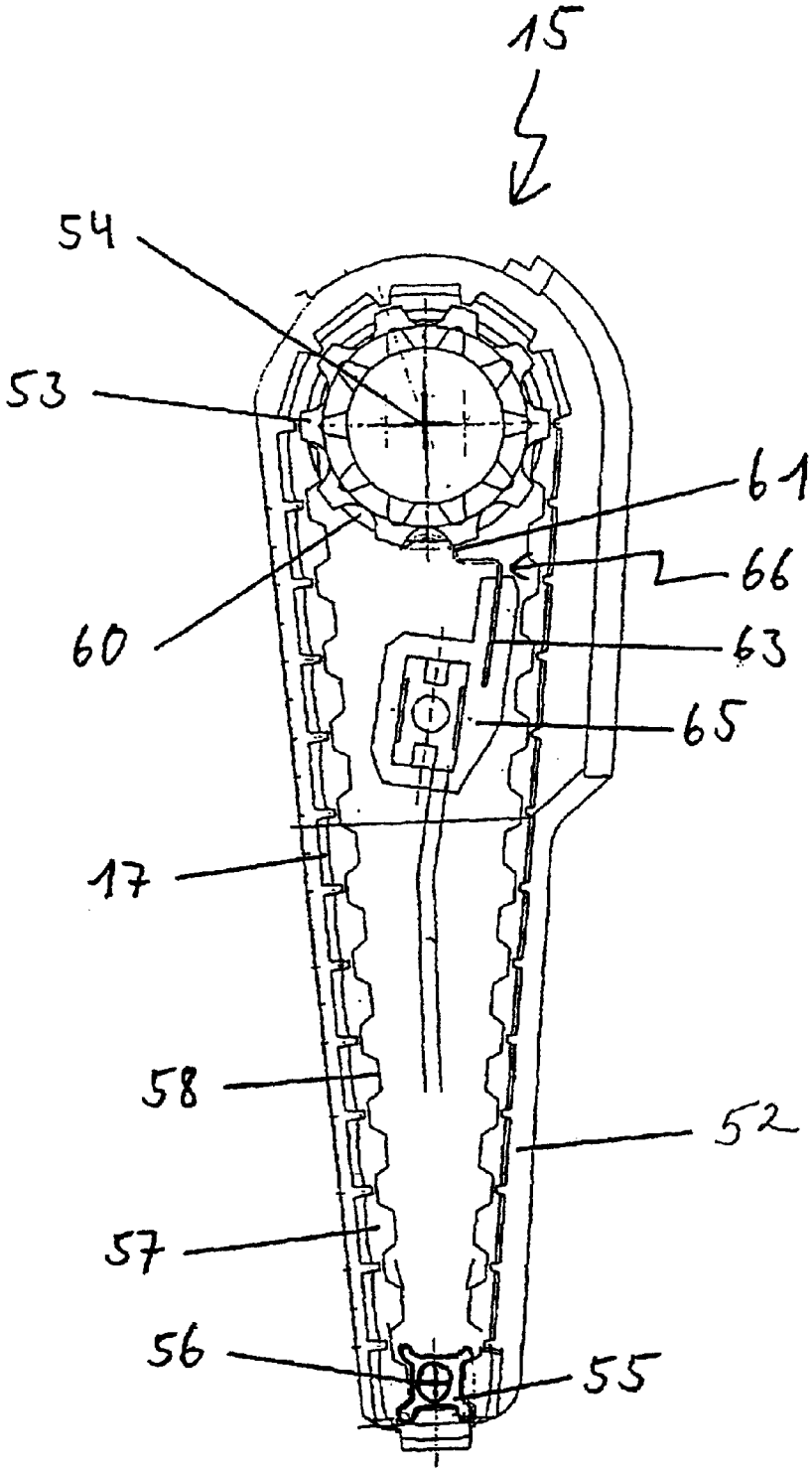
FIG. 1 is a cross-sectional view of a printer according to the invention, which has a comb-shaped stop spring with elastic tongues and is set in a retaining block.

The printer 15 is shown with a casing 52 in FIG. 1. A selector wheel 53 mounted to rotate about a shaft 54 is shown in the casing, and spaced apart from this is a counter-pressure element 55 capable of rotation about a shaft 56. An endless printing band 57 is wrapped around the selector wheel 53 and the counter-pressure element 55. The printing band 57 has print types 17 on its outer side and projections 58 on its inner side. Where the printing band 57 wraps around the selector wheel 53, the projections 58 engage with recesses 60 provided on the outer periphery of the selector wheel 53. A retaining block 65 with a stop member is arranged between the selector wheel 53 and the counter-pressure element 55. The stop member is a comb-shaped stop spring 66 and comprises a base part 63 and upwardly projecting elastic tongues 61 formed on the base part. The comb-shaped stop spring 66 is inserted from above by its base part 63 into a slot in the retaining sheet 65.

Figure 2:
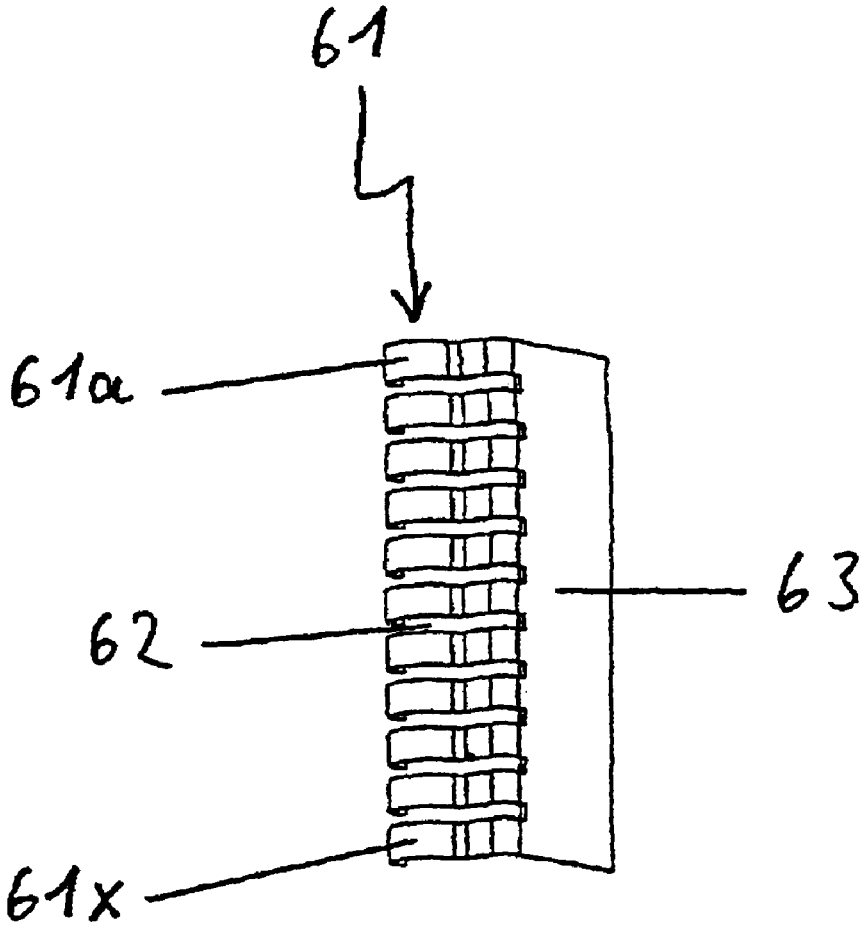
FIG. 2 is a detail view of a comb-shaped stop spring of the printer according to FIG. 1.

FIG. 2 clearly reveals that the individual elastic tongues 61*a* thru 61*x* are spaced apart by gaps 62 as in the teeth of a comb. The number of elastic tongues 61*a* thru 61*x* always corresponds to the number of selector wheels 53 and printing bands 57 mounted in the printer 15. The elastic tongues 61 are formed on the common base part 63.

Figure 3:
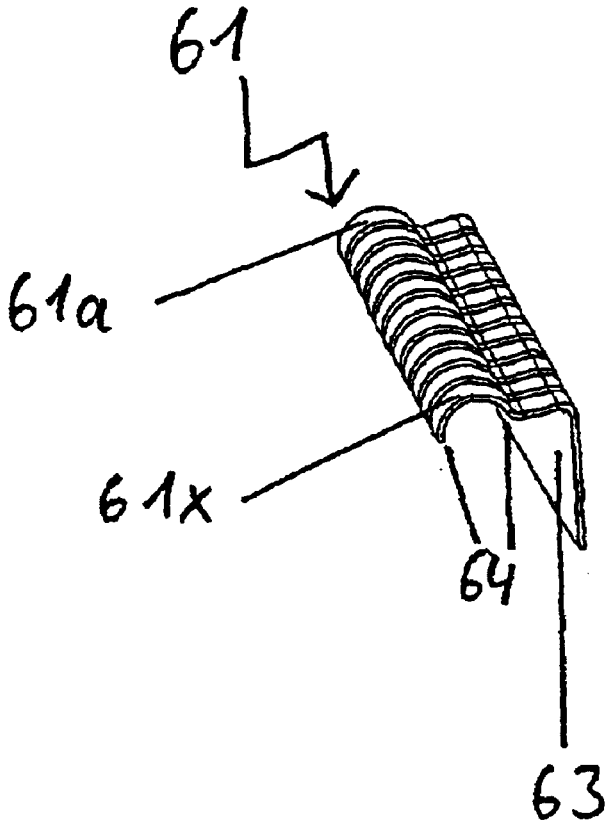
FIG. 3 is a perspective view of the comb-shaped stop spring according to FIG. 2.

FIG. 3 shows that each elastic tongue 61 has an arcuate segment 64 that engages in a respective engagement recess 60 of a respective selector wheel 53 on reaching a printing position, thereby fixing the selector wheel 53, and hence the printing band 57 as well, in the printing position.

Figure 4:
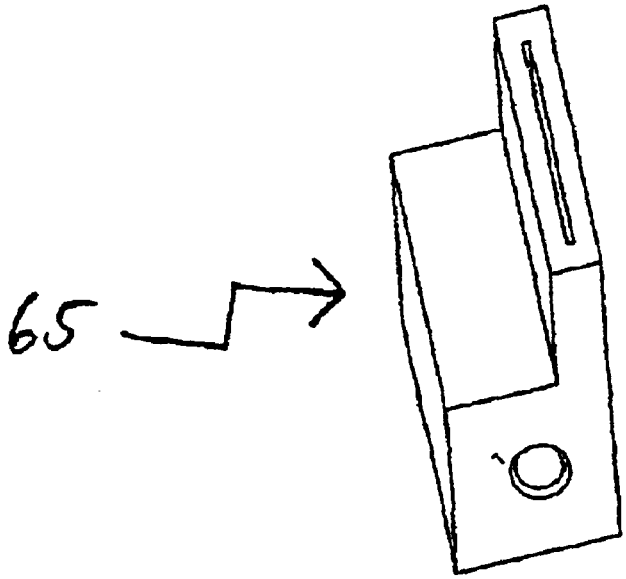
FIG. 4 is a detail perspective view of a retaining block of the printer according to FIG. 1.

FIG. 4 shows a perspective view of a retaining block 65, into which the base part 63 of the elastic tongues 61 positively engages, thereby becoming fixed in the printer 15.

Figure 5:
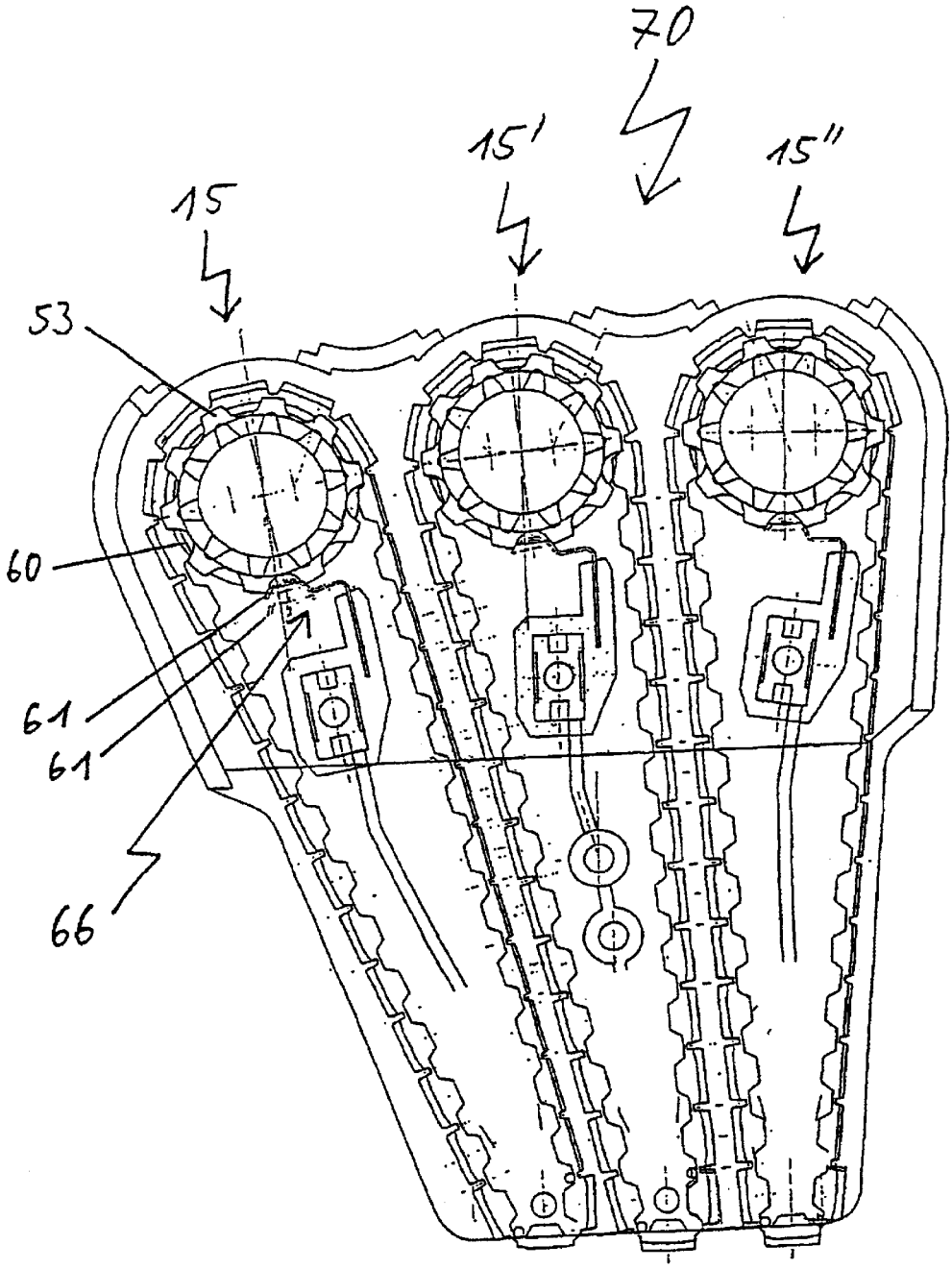
FIG. 5 is a cross-sectional view, similar to FIG. 1, of an embodiment of the invention as a triple printer.

FIG. 5 shows a triple printer 70 with a total of three printers 15, 15', 15" according to the invention. All three printers have a comb-shaped stop spring 66 with upwardly projecting elastic tongues 61. An elastic tongue 61 engaging with an engagement recess 60 of the selector wheel 53 is shown in printer 15 by a solid line. A broken line indicates the elastic tongue 61 in a position in the middle between two engaged positions. In this position the elastic tongue 61 exerts a maximum force on the selector wheel 53.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A printer, comprising a plurality of printing bands, each printing band bearing a plurality of print types and each printing band being positively guided around a single selector wheel and each printing band also being guided around a single counter-pressure element, each counter-pressure element being spaced apart from the corresponding selector wheel, wherein selected print types are set into printing position on the counter-pressure elements by rotation of the selector wheels, the selector wheels having engagement recesses and stop members associated with the selector wheels, such that the stop members elastically engage in one of the engagement recesses when a printing position is reached, thereby fixing the selector wheels and hence the printing bands in the printing position, wherein the stop members comprise a comb-shaped stop spring having individual elastic tongues with one of the elastic tongues being assigned to each selector wheel, each of the elastic tongues having a section that engages in a respective engagement recess of a respective selector wheel, wherein the sections have an arcuate surface that is in substantially full facing engagement with an arcuate surface of the respective engagement recesses, wherein the elastic tongues are formed on a common base part, the tongues having a spacing equal to a spacing of the selector wheels, wherein the elastic tongues and the base part are comprised of spring sheet steel and a retaining block is arranged between the selector wheels and counter-pressure elements of the printer, the retaining block having a slot into which the common base part positively engages by being inserted into the slot from above.

2. The printer according to claim 1, which comprises part of a labeling and marking device.

3. The printer according to claim 2, wherein the device is a hand-labeling device.

* * * * *